US010068756B2

(12) United States Patent
Yoshinari et al.

(10) Patent No.: US 10,068,756 B2
(45) Date of Patent: Sep. 4, 2018

(54) MASS SPECTROMETER

(71) Applicant: HITACHI HIGH-TECHNOLOGIES CORPORATION, Tokyo (JP)

(72) Inventors: Kiyomi Yoshinari, Tokyo (JP); Yasushi Terui, Tokyo (JP)

(73) Assignee: HITACHI HIGH-TECHNOLOGIES CORPORATION, Tokyo (JP)

( * ) Notice: Subject to any disclaimer, the term of this patent is extended or adjusted under 35 U.S.C. 154(b) by 0 days.

(21) Appl. No.: 15/318,858

(22) PCT Filed: May 11, 2015

(86) PCT No.: PCT/JP2015/063411
§ 371 (c)(1),
(2) Date: Dec. 14, 2016

(87) PCT Pub. No.: WO2015/198721
PCT Pub. Date: Dec. 30, 2015

(65) Prior Publication Data

US 2017/0125230 A1 May 4, 2017

(30) Foreign Application Priority Data

Jun. 25, 2014 (JP) ..... 2014-129806

(51) Int. Cl.
*H01J 49/06* (2006.01)
*H01J 49/10* (2006.01)
*H01J 49/42* (2006.01)

(52) U.S. Cl.
CPC ..... *H01J 49/063* (2013.01); *H01J 49/065* (2013.01); *H01J 49/10* (2013.01); *H01J 49/42* (2013.01)

(58) Field of Classification Search
USPC ..... 250/292, 396 R, 281
See application file for complete search history.

(56) References Cited

U.S. PATENT DOCUMENTS 5,847,386 A * 12/1998 Thomson ..... H01J 49/005 250/288
6,417,511 B1 7/2002 Russ, IV et al.
6,753,523 B1 6/2004 Whitehouse et al.
(Continued)

FOREIGN PATENT DOCUMENTS

DE 603 09 700 T2 9/2007
JP H03-74042 A 3/1991
(Continued)

OTHER PUBLICATIONS

International Search Report, dated Jun. 30, 2015, which issued during the prosecution of International Application No. PCT/JP2015/063411, which corresponds to the present application.
(Continued)

*Primary Examiner* — Kiet T Nguyen
(74) *Attorney, Agent, or Firm* — Baker Botts L.L.P.

(57) ABSTRACT

The objective of the presently disclosed subject matter is to provide a mass spectrometer that improves the ionic permeability ratio at the entrance to an ion transport part or the entrance to a mass spectrometry part, and to acquire a high-sensitivity mass spectrum. To reduce the electric-field distortion that is caused by ion loss, electrodes are arranged so that the radius of a circle inscribed within the electrodes of the ion transport part is larger than the radius of a circle inscribed within the electrodes of the mass spectrometry part. The entrance to the electrodes of the mass spectrometry part also can have a tapered, inclined, folded-over, or rounded configuration. Together, these reduce the sharply fluctuating (peak-shaped) distribution of electric potential generated near the entrance to the ion transport part and the entrance to the mass spectrometry part.

8 Claims, 7 Drawing Sheets

(56) References Cited

U.S. PATENT DOCUMENTS

| | | | | |
|---|---|---|---|---|
| 7,868,289 | B2 * | 1/2011 | Cousins | H01J 49/063 250/281 |
| 2003/0222213 | A1 | 12/2003 | Taniguchi | |
| 2004/0011956 | A1 * | 1/2004 | Londry | H01J 49/4225 250/292 |
| 2007/0120053 | A1 * | 5/2007 | Loboda | G01N 23/00 250/307 |
| 2009/0302209 | A1 | 12/2009 | Green et al. | |
| 2010/0171035 | A1 | 7/2010 | Okumura et al. | |
| 2011/0278450 | A1 | 11/2011 | Loucks, Jr. et al. | |
| 2014/0252217 | A1 | 9/2014 | Okumura et al. | |
| 2016/0133452 | A1 * | 5/2016 | Bertsch | H01J 49/063 250/292 |

FOREIGN PATENT DOCUMENTS

| | | | |
|---|---|---|---|
| JP | 2002-502085 | A | 1/2002 |
| JP | 2004-014177 | A | 1/2004 |
| JP | 2009-535761 | A | 10/2009 |
| JP | 2011-238616 | A | 11/2011 |
| WO | WO 2009/081445 | A1 | 7/2009 |
| WO | WO 2013/057822 | A1 | 4/2013 |
| WO | WO 2013/093077 | A2 | 6/2013 |

OTHER PUBLICATIONS

Office Action, dated Feb. 6, 2018, which issued during the prosecution of German Patent Application No. 112015002415.8, which corresponds to the present application (English translation attached).

* cited by examiner

[Fig. 1]
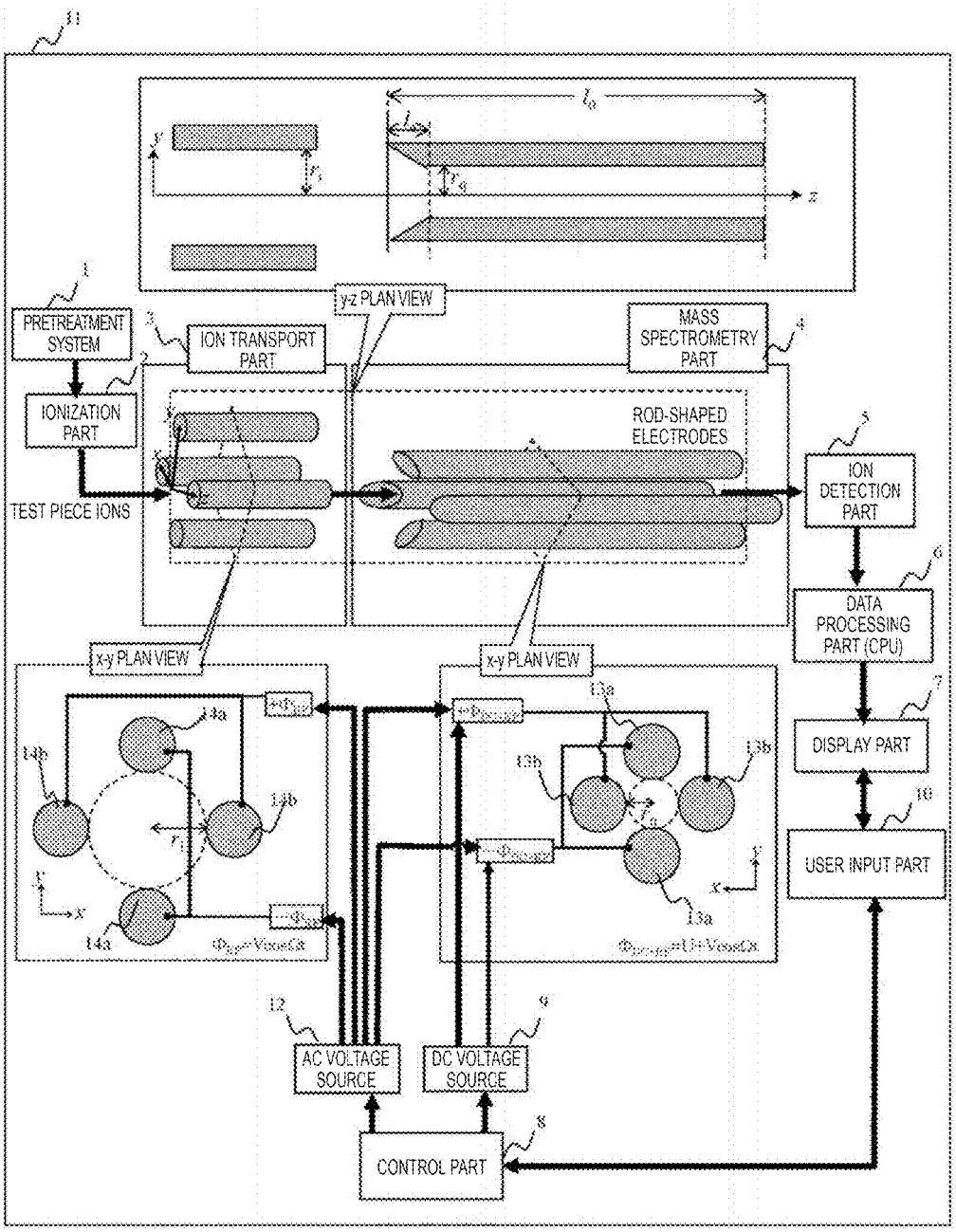

[Fig. 2]
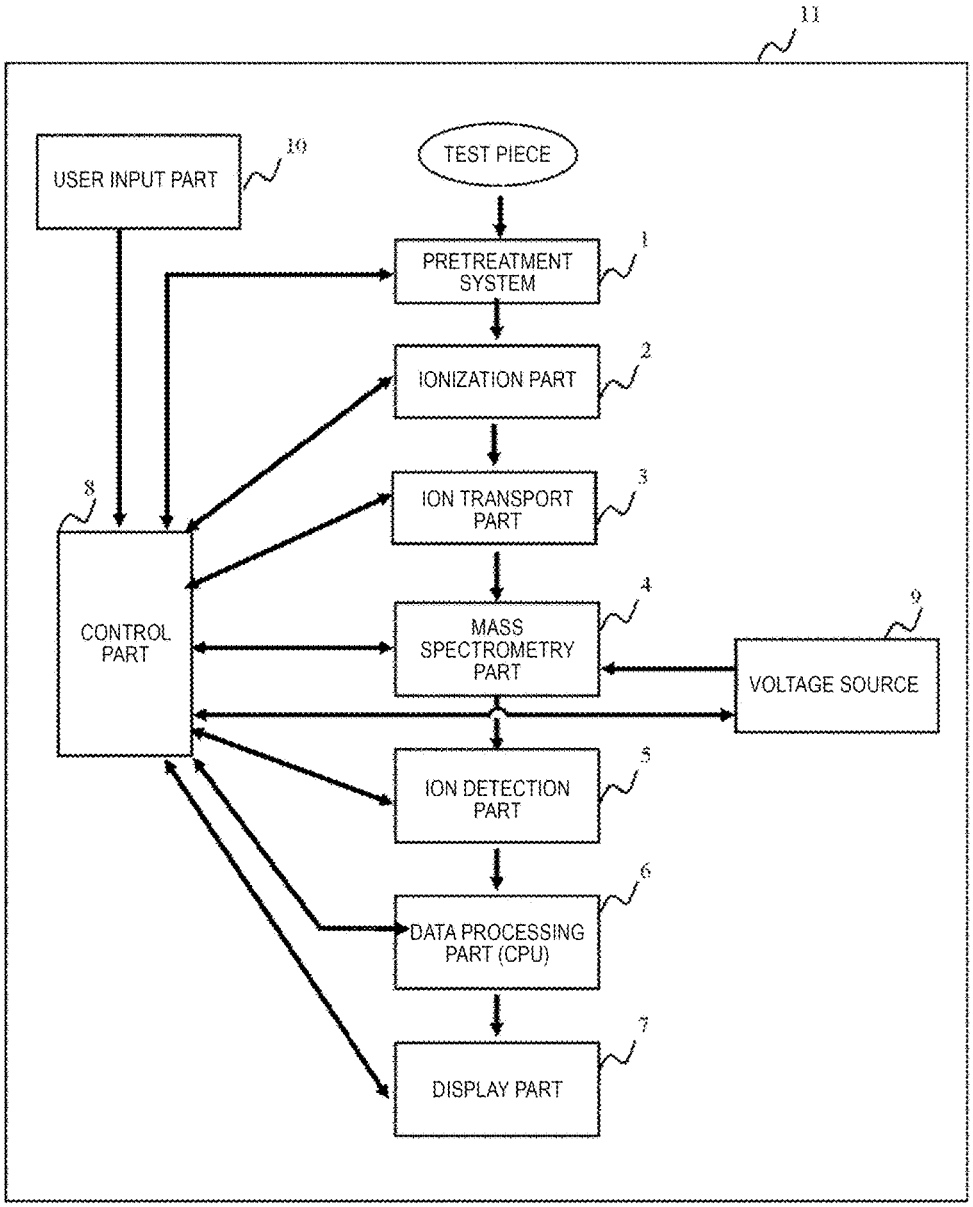

[Fig. 3]
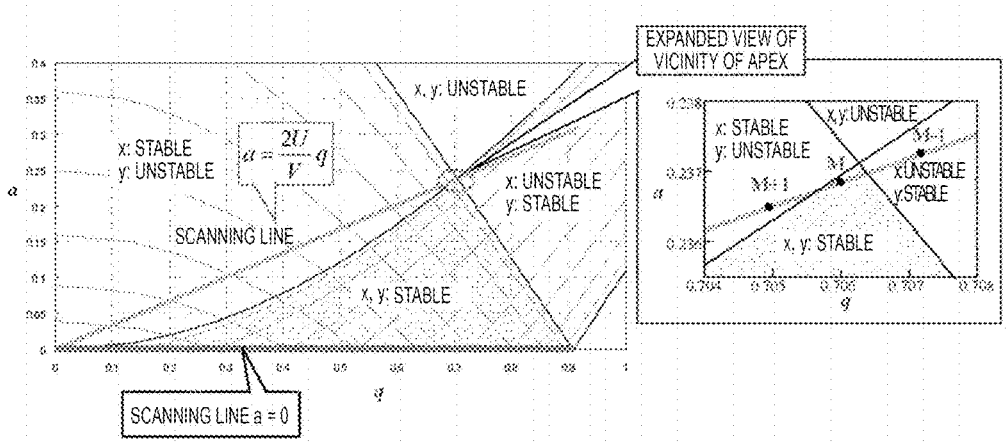
[Fig. 4]
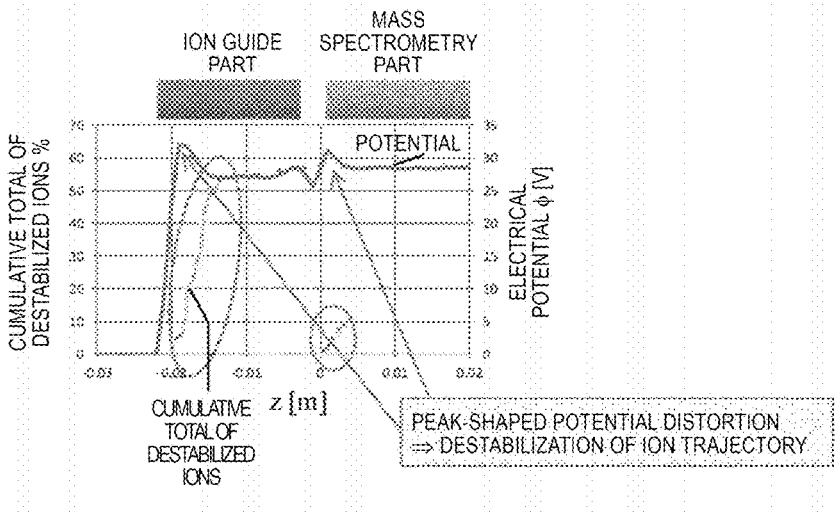

[Fig. 5]
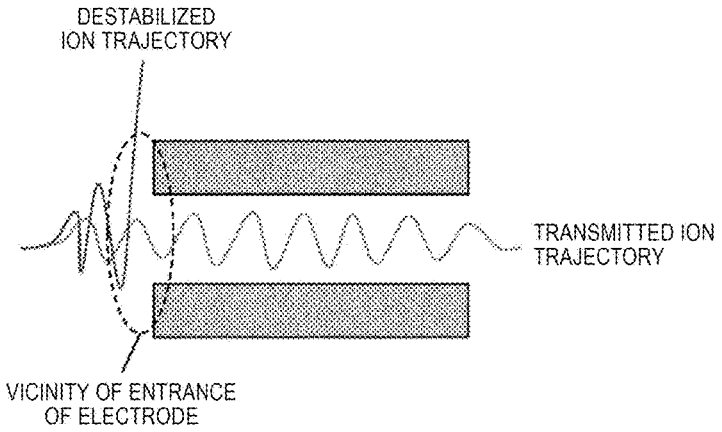
[Fig. 6]
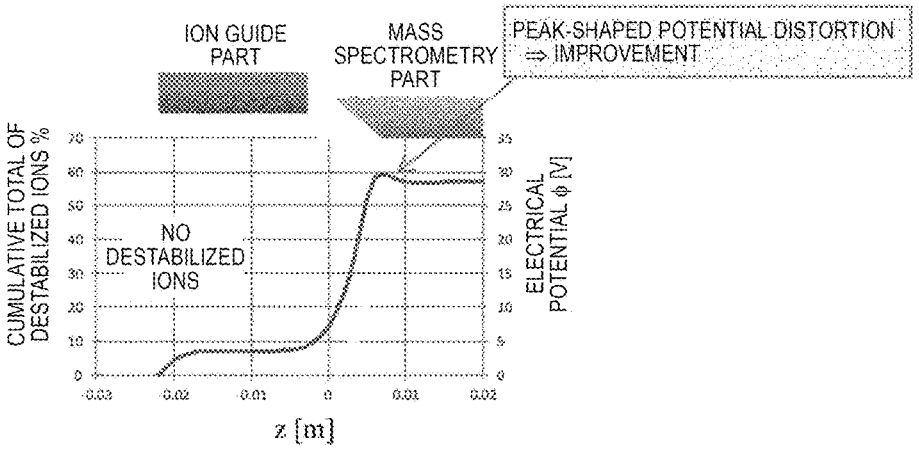

[Fig. 7]
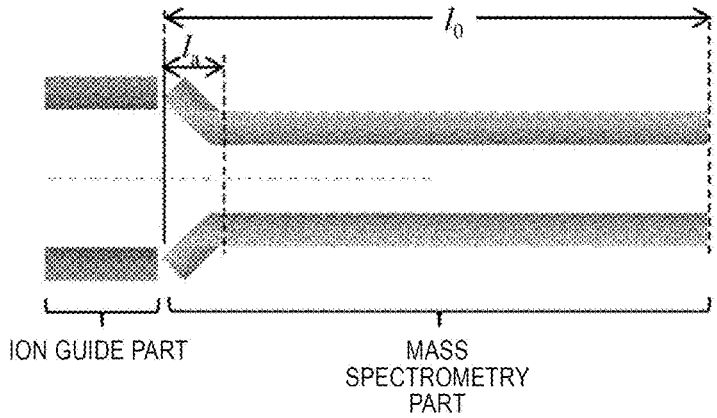
[Fig. 8]
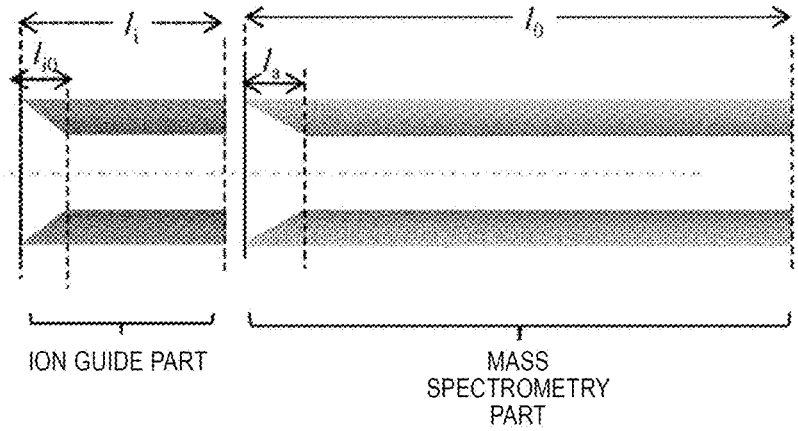

[Fig. 9]
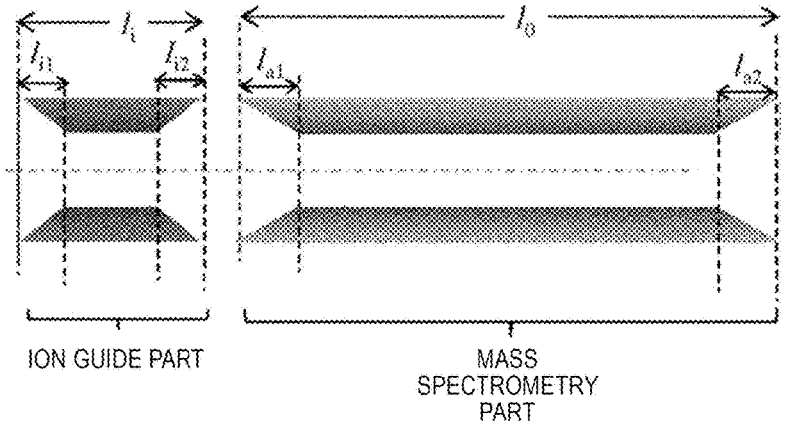
[Fig. 10]
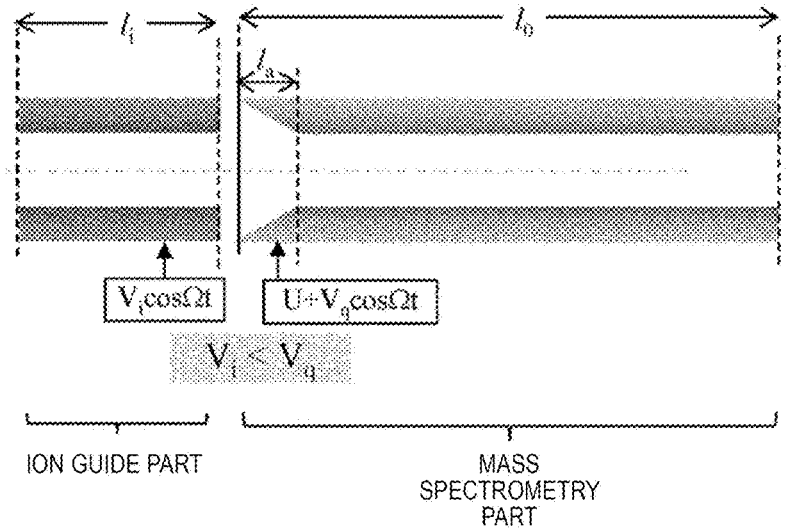

[Fig. 11]
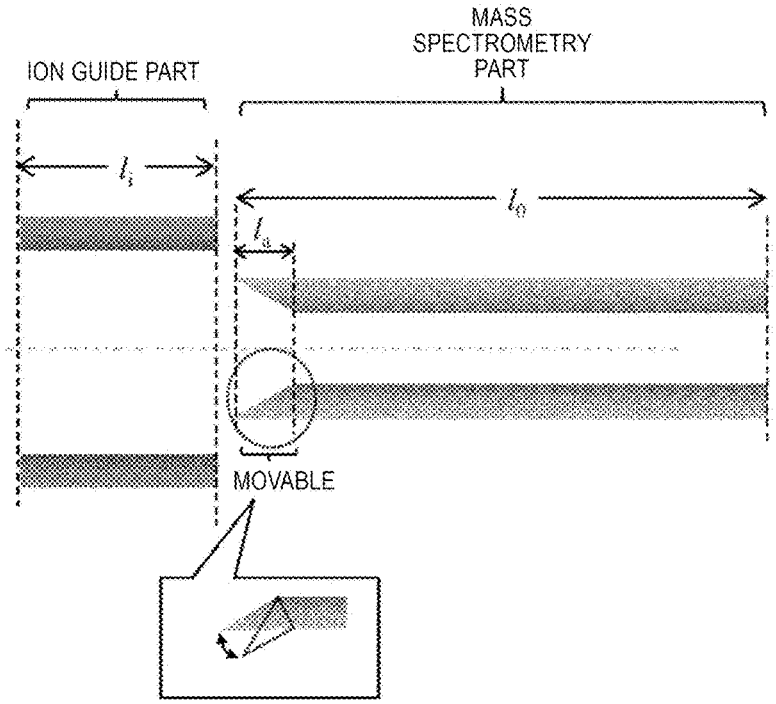
[Fig. 12]
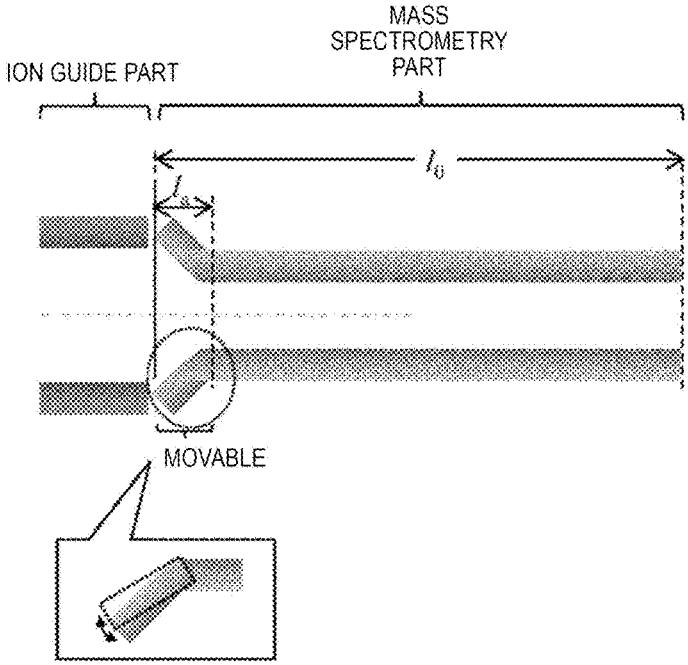

MASS SPECTROMETER

CROSS REFERENCE TO PRIOR APPLICATIONS

This application is a U.S. National Phase application under 35 U.S.C. § 371 of International Application No. PCT/JP2015/063411, filed on May 11, 2015, which claims benefit of priority to Japanese Application No. 2014-129806, filed on Jun. 25, 2014. The International Application was published in Japanese on Dec. 30, 2015 as WO 2015/198721 A1 under PCT Article 21(2). The contents of the above applications are hereby incorporated by reference.

TECHNICAL FIELD

The presently disclosed subject matter relates to a mass spectrometer that uses a quadrupole type mass spectrometer, and in particular, to a mass spectrometer in which high sensitivity is required, such as in a case of an analysis application of a test piece inside a biological body.

BACKGROUND ART

In the related art, a mass spectrometer that uses a quadrupole type mass spectrometer is formed from at least four rod-shaped electrodes, in which a DC voltage U and a high-frequency voltage Vqcos $(\Omega_q t+\phi_0)$ are applied to the rod-shaped electrodes. There are many cases in which an ion transport part (an ion guide part), formed from at least four rod-shaped or plate-shaped electrodes, and in which only a high-frequency voltage Vicos $(\Omega_i t+\phi_0)$ is applied, is installed separately from a mass spectrometry part. Such an ion transport part performs mass selection of and separates ion types having specific mass-to-charge ratios m/z in a stage prior to the mass spectrometry part in order to decrease ion loss when an ion beam from a test piece is caused to be incident to the mass spectrometry part.

At this time, in a case where the radius of an inscribed circle, in which the shortest distance between opposing electrodes of the electrodes of the ion transport part is set as the diameter, is set as $r_i$, and the radius of an inscribed circle, in which the shortest distance between opposing electrodes of the electrodes of the mass spectrometry part is set as the diameter, is set as $r_q$, the ion transport part and the mass spectrometry part are disposed so that $r_i=r_q$. In addition, voltages are applied so that $V_i=V_q$ and $\Omega_i=\Omega_q$. From this point onwards, an inscribed circle, in which the shortest distance between opposing electrodes is set as the diameter, will be referred to as an inscribed circle of rod-shaped electrodes.

In addition, in the manner disclosed in PTL 1, with respect to the electrodes of the ion transport part, the ion transport part electrodes being disposed so that a relationship of $r_{i1}>r_{i2}$ is established where the radius of an inscribed circle of rod-shaped electrodes in a position in which ions are incident to the ion transport part, is set as $r_{i1}$, and the radius of an inscribed circle of rod-shaped electrodes in a position in which ions are emitted from the ion transport part, is set as $r_{i2}$, is disclosed.

CITATION LIST

Patent Literature

PTL 1: JP-A-2011-238616

SUMMARY OF INVENTION

Technical Problem

In an apparatus that performs mass spectrometry by scanning the mass-to-charge ratio m/z of a mass selection or a separation target, and outputting an ion detection number (a mass spectrum) for each mass-to-charge ratio m/z, and in particular, of performing mass spectrometry of a minor component that is included in a test piece or the like, a technique is required to account for the loss of the ion number is low due to ion trajectory up until the ions are eventually count detected as being unstable. As shown in FIG. 3, in the related art, peak-shaped electrical potential barriers are formed at the entrance to an ion guide part and at the entrance to a mass spectrometry part. As electrical potential distributes, distortion of the electric field is generated, the ion trajectory becomes unstable, and ion loss is generated as a result.

The fact that ion loss is principally generated due to the following reasons is evident from the results of simulations.

- Ion loss at the entrance to the ion transport part (ion guide).
- Ion loss at the entrance to the mass spectrometry part (the quadrupole mass spectrometry part).

Ion loss refers to the ion number (the detection sensitivity) that is detected as decreasing due to the ion trajectory. Ion loss is expected to pass through an inner side of the ion transport part or the mass spectrometry part, become unstable, and be ejected to an outer side of the ion transport part or the mass spectrometry part. It is thought that the cause of this kind of ion loss, as shown in FIG. 5, is that peak-shaped potential barriers occur in the distribution of electrical potential, and therefore, the ion trajectory becomes unstable. In order to solve the above-mentioned technical problem, it is necessary to reduce the distortion of the electric field due to peak-shaped electrical potential barriers that are generated at the entrance to the ion transport (ion guide) part and the entrance to the mass spectrometry part.

Solution to Problem

A mass spectrometer of the presently disclosed subject matter is provided with a mass spectrometry part that transmits only ion types having a specific mass-to-charge ratio m/z, and includes at least four first rod-shaped electrodes, a control part that adjusts and controls a voltage that is applied to the first rod-shaped electrodes, and a detection part that detects ions that are transmitted by the first rod-shaped electrodes, and where the size of an inscribed circle of at least one end part of the first rod-shaped electrodes is larger than the size of an inscribed circle of another portion of the first rod-shaped electrodes.

For example, in a quadrupole mass spectrometer, the presently disclosed subject matter is an apparatus that improves the detected ion number (the detection sensitivity) by reducing the potential distribution (peak-shaped distribution), which fluctuates sharply with respect to the potential distribution that is generated in the vicinity of the entrance to the ion transport part and the entrance to the mass spectrometry part, principally using means (1), (2), and the like below in order to solve the above-mentioned technical problem.

(1) The electrodes of the ion guide and the quadrupole mass spectrometry part are disposed so that a relationship of $r_i>r_q$ is established, where the radius of an inscribed circle of a plurality of rod-shaped electrodes of the ion transport part (the ion guide), is set as $r_i$, and the radius of an inscribed circle of a plurality of rod-shaped electrodes of the mass spectrometry part (the quadrupole mass spectrometry part), is set as $r_q$.

(2) The electrode shapes in the vicinity of the entrances to which ions are incident, being made to have an inclined (tapered) shape in which the diameter of an inscribed circle gradually increases in a direction that is opposite to a direction in which ions are incident with respect to the plurality of rod-shaped electrodes of the mass spectrometry part (the quadrupole mass spectrometry part).

Advantageous Effects of Presently Disclosed Subject Matter

The presently disclosed subject matter reduces the sharply fluctuating (peak-shaped) distribution of electric potential generated in the vicinity of the entrance to the mass spectrometry part, that is, the electric-field distortion occurring at the end parts of the electrodes. Therefore, the ionic permeability ratio in the vicinity of the entrance to the mass spectrometry part is greatly improved, and high-sensitivity mass spectrometry is possible.

BRIEF DESCRIPTION OF DRAWINGS

FIG. 1 is a schematic view of the disposition and structure of each electrode of an ion transport part and a mass spectrometry part of the presently disclosed subject matter.

FIG. 2 is an overall schematic view of a mass spectrometer according to the presently disclosed subject matter that measures mass spectrometry data.

FIG. 3 is a view of an ion stable transmission region within a quadrupole electric field.

FIG. 4 is a view that summarizes results of deriving the generated distribution of electrical potential and a cumulative total number of ion destabilization loss of an ion guide and the mass spectrometry part in a case of an electrode disposition and shape of the related art, using a simulation.

FIG. 5 is a conceptual view when ions pass stably or are emitted unstably when incident between four or more rod-shaped electrodes of the ion transport part.

FIG. 6 is a view that summarizes results of deriving the generated distribution of electrical potential and a cumulative total number of ion destabilization loss in a case of an electrode disposition and shape of an ion guide and a mass spectrometry part according to a first embodiment of the presently disclosed subject matter, using a simulation.

FIG. 7 is a conceptual view that represents an electrode shape of a state that is different to an electrode entrance shape of the mass spectrometry part in the first embodiment of the presently disclosed subject matter.

FIG. 8 is a conceptual view that represents an entrance end part shape of each electrode of an ion transport part according to a second embodiment of the presently disclosed subject matter.

FIG. 9 is a conceptual view that represents end part shapes of an entrance and an exit of each electrode of the ion transport part according to the second embodiment of the presently disclosed subject matter.

FIG. 10 is a schematic view of a voltage control method according to a third embodiment of the presently disclosed subject matter that is applied to each electrode of an ion transport part and a mass spectrometry part.

FIG. 11 is a conceptual view of a moving method of an electrode entrance end part of a mass spectrometry part in a fourth embodiment of the presently disclosed subject matter.

FIG. 12 is a conceptual view of a moving method of an electrode entrance end part of the mass spectrometry part in the fourth embodiment of the presently disclosed subject matter.

DESCRIPTION OF EMBODIMENTS

Hereinafter, embodiments of the presently disclosed subject matter will be described with reference to the drawings.

Embodiment 1

Firstly, a first embodiment will be described using FIGS. 1 to 7. FIG. 1 is a view that shows an ion transport part (an ion guide) and a mass spectrometry part (a quadrupole mass spectrometry part), which are features of the first embodiment, and FIG. 2 is an overall configuration view of a mass spectrometer of the present embodiment. An analysis flow of a mass spectrometer 11 is shown.

A test piece of a mass spectrometry subject is temporally separated and fractionated in a pretreatment system 1 such as gas chromatography (GC) or liquid chromatography (LC). Test piece ions that are sequentially ionized in an ionization part 2 are separated by mass as a result of passing through an ion transport part 3 and being incident to a mass spectrometry part 4. In this instance, m is the mass of an ion and z is a charge valence of an ion. The voltage to the mass spectrometry part 4 is applied from a DC voltage source 9 while being controlled from a control part 8. Separated ions are detected by an ion detection part 5, and data reduction and processing are performed by a data processing part 6, and mass spectrometry data, which is a spectrometry result, is displayed on a display part 7. Overall control of this series of mass spectrometry processes—ionization of a test piece, transport and incidence of a test piece ion beam to the mass spectrometry part 4, a mass separation process, ion detection, data processing, and command processing of a user input part 10—is performed using the control part 8.

In this instance, the ion transport part 3 and the mass spectrometry part 4 are configured as quadrupole mass spectrometers that are formed from four rod-shaped electrodes, but can be configured as multipole mass spectrometers that are formed from four or more rod-shaped electrodes. In addition, as shown in FIG. 1, when a longitudinal direction of the rod-shaped electrodes is set as a z direction, and a cross-sectional direction is set as an x, y plane, in the manner that is shown in the x, y cross-sectional view of the rod-shaped electrodes, the four rod-shaped electrodes can be columnar electrodes, or can be rod-shaped electrodes in which a bipolar surface shape such as that shown by the dotted line is formed.

In the four electrodes in the mass spectrometry part 4, facing electrodes are configured as a set, voltages of opposite phases of voltages onto which a high-frequency voltage is superimposed on a DC voltage, +(U+V cos Ωt) and −(U+V cos Ωt), are applied to two sets of electrodes 13*a* and 13*b*, and high-frequency electric fields Ex and Ey, which are shown in Formula (1), are generated between the four rod-shaped electrodes.

$$E_x = \frac{\partial \Phi}{\partial x} = -\frac{2(U + V\cos\Omega t)}{r_0^2} \cdot x, \quad (1)$$

$$E_y = \frac{\partial \Phi}{\partial y} = +\frac{2(U + V\cos\Omega t)}{r_0^2} \cdot y$$

Ionized test piece ions are guided along a central axis (the z direction) between the rod-shaped electrodes, and pass through the center of the high-frequency electric fields of Formula (1). The stability of the ion trajectories in the x and y directions at this time is determined by following non-dimensional parameters a and q, which are derived from motion equations (Mathieu functions) of ions between rod-shaped electrodes.

$$a = \frac{8eU}{\Omega^2 m r_0^2} \tag{2}$$

$$q = \frac{4eV}{\Omega^2 m r_0^2} \tag{3}$$

In this instance, a valence z is set to 1. Cases in which $z \neq 1$ are shown in Formulae (2) and (3). $r_0$ is half the value of the distance between opposing rod electrodes, e is an elementary charge, m is an ion mass, U is the DC voltage that is applied to the rod electrodes, and V and Ω are the amplitude and angular frequency of the high-frequency voltage. Once the values of $r_0$, U, V, and Ω are determined, depending on the atomic mass number m thereof, each ion type corresponds to different (a, q) points on an a-q plane in FIG. 3. At this time, due to Formulae (2) and (3), the different (a, q) points of each ion type are all on a straight line of Formula (4).

$$a = \frac{2U}{V} q \tag{4}$$

A quantitative range (a stability transmit region) of a and q, which gives a stability solution, is shown in FIG. 3 for ion trajectories in both x and y directions. Only ion types having a given specific atomic mass number M are transmitted between the rod-shaped electrodes. In order to perform mass separation by unstably emitting other ion types to outside the QMS, it is necessary to adjust the U and V ratios so as to intersect the vicinity of the apex of the stable transmission region in FIG. 3. While stably transmitted ions vibrate, and transmit between the rod-shaped electrodes in the z direction, the vibrations of destabilized ions spread and are emitted in the x and y directions. The straight line of Formula (4) is referred to as a mass scanning line, and the atomic mass number M of the ion types that are stably transmitted between the rod-shaped electrodes and are separated by mass, and are scanned by sequentially scanning the U and V values while retaining the inclination (U/V ratio) of the mass scanning line.

$$U = \frac{m r_0^2 \Omega^2}{8e} a \tag{5}$$

$$V = \frac{m r_0^2 \Omega^2}{4e} q \tag{6}$$

At this time, due to Formulae (5) and (6) into which Formulae (2) and (3) are transformed, normally, the atomic mass number M of ion types are scanned by increasing the U and V values in proportion with the ion mass m.

Meanwhile, in the ion transport part 3 (the ion guide), in the four electrodes, facing electrodes are configured as a set, and only voltages of high-frequency voltages of respectively opposite phases, +V cos Ωt and −V cos Ωt, are applied to two sets of electrodes 14*a* and 14*b*, and high-frequency electric fields Ex and Ey, which are shown in Formula (7) are generated between the four rod-shaped electrodes.

$$E_x = \frac{\partial \Phi}{\partial x} = -\frac{2(V\cos\Omega t)}{r_0^2} \cdot x, \quad E_y = \frac{\partial \Phi}{\partial y} = +\frac{2(V\cos\Omega t)}{r_0^2} \cdot y \tag{7}$$

Since the DC voltage is not applied to the ion transport part, U=0, and due to Formula (4), a mass scanning line of a case of the ion transport part corresponds to Formula (8).

$$a=0 \tag{8}$$

Accordingly, as shown in FIG. 3, theoretically, it is expected that all ion types that are equivalent to the region where the stable transmit region and a scanning line of a=0 intersect can transmit. However, in practice, as shown in FIG. 4, a distribution having sharp fluctuations (a peak-shape) in potential is generated at the entrance to the ion transport part 3 (the ion guide), and as a result of this, since a portion of ions at the entrance to the ion guide are destabilized, and do not pass through the ion guide, the ion number is lost, and this leads to a decrease in detection sensitivity. A conceptual view of a state in which a portion of the ions in the vicinity of the electrode entrances of the ion guide part or the mass spectrometry part, is destabilized, is shown in FIG. 5.

In the present embodiment, as shown in FIG. 1, the respective electrodes are disposed so that the radius $r_i$ of an inscribed circle of the four, or four or more electrodes of the ion guide part is larger than the radius $r_q$ of an inscribed circle of the four or more rod-shaped electrodes of the mass spectrometry part.

$$r_i > r_q \tag{9}$$

Furthermore, as shown in FIG. 1, the shape of the entrance end part of each rod-shaped electrode of the mass spectrometry part is characterized by having a tapered shape. Alternatively, as a variation, the shape of the entrance end part of each rod-shaped electrode can have a roundness in which portions that face one another are cut out. As shown in the y-z plan view of FIG. 1, the tapered shape is characterized by having an inclined (tapered) shape in which the diameter of an inscribed circle gradually increases in a direction that is opposite to a direction in which ions are incident. As a result of this, as shown in FIG. 6, the distribution having a sharply fluctuating (peak-shaped) electrical potential, which is generated in the vicinities of the entrances to the ion guide and the mass spectrometry part, is reduced, and in accordance with this, the ion loss rates in the vicinities of the entrances to the ion guide and the mass spectrometry part are greatly decreased, that is, it is possible to further confirm, using a simulation, that the ionic permeability ratio is greatly improved. Accordingly, as a result of the present embodiment, the distribution having a sharply fluctuating (peak-form) electrical potential, which is generated in the vicinities of the entrances to the ion guide and the mass spectrometry part, is reduced, and therefore, it is thought that it is possible to expect an improvement in ion sensitivity. In this instance, in place of a tapered shape, as shown in FIG. 7, each electrode shape at the entrance to the mass spectrometry part can be an electrode shape that is bent toward an outer side so that an entrance side increases. In addition, in the case of FIG. 1, or in a case such as that of FIG. 7, when the overall length of an electrode is set as $l_0$, it is desirable that a length $l_a$ of a tapered shape portion and a length $l_a$ (a z direction length) of a portion that has a curvature are $l_0/3$ or less in order to retain mass separation accuracy.

$$la \leq l_0/3 \quad (10)$$

Embodiment 2

Next, a second embodiment will be described using FIGS. 8 and 9. In this instance, as shown in FIG. 8, the ion transport part (the ion guide part) is also characterized by a shape in which the electrode cross-sectional shape of the entrance end part has an inclined shape in which portions that face one another are cut out. According to the present embodiment, in a similar manner to the case of the vicinity of the electrode entrance of the mass spectrometry part in the first embodiment, the distribution having a sharply fluctuating (peak-shaped) electrical potential in the vicinity of the entrance to the ion transport part, is reduced, and therefore, destabilization of the ion trajectory is prevented, and it is possible to expect an effect of stable transmission. As shown in FIG. 9, by configuring the exit end parts to have a tapered shape in addition to just the entrance end parts of the electrodes in the ion transport part and the mass spectrometry part, it is thought that distortion of an electric field due to sharp fluctuations in the potential distribution in the exit portions, is reduced, and therefore, it is thought that there is an effect of also improving the ionic permeability ratio in the exit portions.

Embodiment 3

Next, a third embodiment will be described using FIG. 10. In this instance, as shown in FIG. 10, voltages are applied so that the following relationship is established between an amplitude value $V_i$ of the high-frequency voltage, which is applied to the electrodes of the ion transport (ion guide) part 3, and an amplitude value $V_q$ of the high-frequency voltage $V_q \cos(\Omega_q t+\phi_0)$, which is applied to the electrodes of the mass spectrometry part with respect to a high-frequency voltage $\pm V_i \cos(\Omega_i t+\phi_0)$, which is applied to electrodes of the ion transport (ion guide) part and a superimposed voltage $\pm(U+V_q \cos(\Omega_q t+\phi_0))$ of the DC voltage U and the high-frequency voltage $Vq\cos(\Omega_q t+\phi_0)$, which is applied to the electrodes of the mass spectrometry part.

$$V_i < V_q \quad (11)$$

In comparison with the first embodiment in which the inscribed circle radius $r_i$ of each electrode of the ion transport part is configured to be larger than the inscribed circle radius $r_q$ of each electrode of the mass spectrometry part in order to reduce the sharp fluctuations in the potential distribution of the ion transport part, in the present embodiment, it is possible to reduce the sharp fluctuations in the potential distribution of the ion transport part by merely adjusting the application voltage in a state in which the inscribed circle radius of each electrode of the ion transport part is $r_i=r_q$. At this time, in a case in which the ionic permeability ratio differs for each ion type or the like, adjustment for each ion type is possible because fine adjustment is possible using the application voltage. Therefore, it is thought that an improvement in ion sensitivity can be expected across a wide range (mass range) of mass-to-charge ratios of analysis subjects.

Embodiment 4

Next, a fourth embodiment will be described using FIGS. 11 and 12. In this instance, as shown in FIGS. 11 and 12, the portions of the tapered shape or the folded over shape at the entrance end part of each electrode of the mass spectrometry part are movable. In other words, since it is possible to finely adjust the angle of the portions of the tapered shape or the folded over shape at the entrance end part of each electrode, in a case in which the ionic permeability ratio differs for each ion type, or the like, adjustment for each ion type is possible, and therefore, it is thought that it is possible to expect an improvement in ion sensitivity across a wide range (mass range) of mass-to-charge ratios of analysis subjects. In addition, since it is also possible to adjust a proximity metric with the ion transport (ion guide) part, it is thought that there is a possibility that ion loss will be further suppressed between the ion transport part and the mass spectrometry part.

REFERENCE SIGNS LIST

1 PRETREATMENT SYSTEM
2 IONIZATION PART
3 ION TRANSPORT PART
4 MASS SPECTROMETRY PART
5 ION DETECTION PART
6 DATA PROCESSING PART
7 DISPLAY PART
8 CONTROL PART
9 DC VOLTAGE SOURCE
10 USER INPUT PART
11 MASS SPECTROMETER
12 AC POWER SOURCE
13*a, b, c* AND *d* ELECTRODE
14*a, b, c* AND *d* ELECTRODE

The invention claimed is:

1. A mass spectrometer comprising:

a mass spectrometry part that transmits only ion types having a specific mass-to-charge ratio m/z, and includes at least four first rod-shaped electrodes;

a control part that adjusts and controls a voltage that is applied to the first rod-shaped electrodes; and a detection part that detects ions that are transmitted by the first rod-shaped electrodes, wherein the size of an inscribed circle of at least one end part of the first rod-shaped electrodes is larger than the size of an inscribed circle of another portion of the first rod-shaped electrodes, and at least one end part of the first rod-shaped electrodes has an inclined shape in which portions that face one another are cut out, and wherein at least one end part of the first rod-shaped electrodes is movable.

2. The mass spectrometer according to claim 1, further comprising:

an ion guide part that transports ions.

3. The mass spectrometer according to claim 2, wherein the ion guide part includes at least two plate-shaped electrodes.

4. The mass spectrometer according to claim 2, wherein the ion guide part includes at least four second rod-shaped electrodes.

5. The mass spectrometer according to claim 4, wherein the size of an inscribed circle that is inscribed within the second rod-shaped electrodes, which configure the ion guide part, is larger than the size of an inscribed circle that is inscribed within the first rod-shaped electrodes, which configure the mass spectrometry part.

6. The mass spectrometer according to claim 4, wherein the size of an inscribed circle of at least one end part of the second rod-shaped electrodes, which configure the ion guide part, is larger than the size of an inscribed circle of another portion of the second rod-shaped electrodes.

7. The mass spectrometer according to claim 6, wherein at least one end part of the second rod-shaped electrodes has an inclined shape in which portions that face one another are cut out.

8. A mass spectrometer comprising:

a mass spectrometry part that transmits only ion types having a specific mass-to-charge ratio m/z, and includes at least four first rod-shaped electrodes;

a control part that adjusts and controls a voltage that is applied to the first rod-shaped electrodes; and a detection part that detects ions that are transmitted by the first rod-shaped electrodes, wherein the size of an inscribed circle of at least one end part of the first rod-shaped electrodes is larger than the size of an inscribed circle of another portion of the first rod-shaped electrodes, and at least one end part of the first rod-shaped electrodes has a shape that is folded over toward an outer side, and wherein at least one end part of the first rod-shaped electrodes is movable.

* * * * *